US006924436B2

(12) United States Patent
Varkey et al.

(10) Patent No.: US 6,924,436 B2
(45) Date of Patent: Aug. 2, 2005

(54) PARTIAL DISCHARGE RESISTANT ELECTRICAL CABLE AND METHOD

(75) Inventors: Joseph P. Varkey, Missouri City, TX (US); Noor F. Sait, Pearland, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 10/350,866

(22) Filed: Jan. 24, 2003

(65) Prior Publication Data

US 2003/0178223 A1 Sep. 25, 2003

Related U.S. Application Data

(60) Provisional application No. 60/366,328, filed on Mar. 21, 2002.

(51) Int. Cl.[7] ..... H01B 7/00
(52) U.S. Cl. ..... 174/120 R
(58) Field of Search ..... 174/120 R, 120 SR, 174/120 C

(56) References Cited

U.S. PATENT DOCUMENTS

| | | | | | |
|---|---|---|---|---|---|
| 4,734,545 | A | * | 3/1988 | Susuki et al. | 174/120 SR |
| 5,220,133 | A | * | 6/1993 | Sutherland et al. | 174/120 R |
| 5,426,264 | A | * | 6/1995 | Livingston et al. | 174/102 R |
| 5,654,095 | A | * | 8/1997 | Yin et al. | 428/372 |
| 5,718,974 | A | * | 2/1998 | Kmiec | 428/383 |
| 5,782,730 | A | * | 7/1998 | Kawasaki et al. | 492/56 |
| 6,060,205 | A | * | 5/2000 | Takeichi et al. | 430/126 |
| 6,184,473 | B1 | * | 2/2001 | Reece et al. | 174/110 R |
| 6,359,230 | B1 | * | 3/2002 | Hildreth | 174/110 R |
| 6,534,717 | B2 | * | 3/2003 | Suzuki et al. | 174/120 R |
| 6,600,108 | B1 | * | 7/2003 | Mydur et al. | 174/120 R |
| 2002/0062984 | A1 | * | 5/2002 | Dlugas | 174/120 R |

FOREIGN PATENT DOCUMENTS

| | | |
|---|---|---|
| EP | 0 365 152 A1 | 9/1989 |
| EP | 1 331 648 A2 | 7/2003 |
| JP | 07320560 | 12/1995 |
| JP | 2001067944 | 3/2001 |
| JP | 2003051214 | 2/2003 |
| WO | 98/31022 | 7/1998 |

* cited by examiner

*Primary Examiner*—Chau N. Nguyen
(74) *Attorney, Agent, or Firm*—David Cate; Robin Nava; Tim Curington

(57) ABSTRACT

An electrical cable includes a conductor comprising a plurality of strands defining interstices therebetween and a first insulating layer comprising a polymer that is disposed on the conductor such that the first insulating layer substantially fills the interstices. Alternatively, an electrical cable includes a conductor comprising a plurality of strands defining interstices therebetween, a first insulating layer comprising a polymer that is disposed on the conductor such that the first insulating layer substantially fills the interstices, and an adhesion layer comprising a polymer that is disposed on the first insulating layer. The electrical cable further comprises a second insulating layer comprising a polymer that is disposed on the adhesion layer, wherein the adhesion layer is miscible with the polymer of the first insulating layer and the polymer of the second insulating layer.

23 Claims, 10 Drawing Sheets

PARTIAL DISCHARGE RESISTANT ELECTRICAL CABLE AND METHOD

CROSS-REFERENCE TO RELATED APPLICATIONS

This application claims priority from Provisional Application No. 60/366,328, filed Mar. 21, 2002, which is incorporated herein by reference.

BACKGROUND OF THE INVENTION

1. Field of the Invention

This invention relates to electrical cabling and, more particularly, to a partial discharge resistant electrical cable and a method for manufacturing the cable.

2. Description of Related Art

Generally, oilfield wireline operations concern the testing and measurement of geologic formations proximate a well periodically prior to completion or after the well has been fully drilled. Electrical power requirements for tools used to test and measure the geologic formations have increased over time as the capabilities of the tools have improved. Accordingly, cables used to deliver electrical power to the tools are required to handle greater amounts of power.

As the electrical voltage applied to a cable exceeds a critical value, generally known as the inception voltage, a partial discharge of an electrical field within the cable, produced by the electrical voltage across the cable's conductor, may occur. Referring to FIG. 1, conventional cables may contain voids 102 between a conductor 104 and an insulating layer 106 surrounding the conductor 104. Partial discharge may occur within the electrical cable 100 when air or other gases trapped within the voids 102 become ionized by the electrical field. Accordingly, it is generally desirable to at least minimize air or other gases that may have entrapped between the conductor and the insulation.

Generally, conventional wireline cables include stranded copper conductors insulated with fluoropolymers or polyolefins. It is desirable for the insulating materials to be strong, wear resistant, and capable of withstanding high temperatures, so that they are able to tolerate environments typically encountered during manufacturing and use. Such polyolefin-type polymers can generally be easily compression extruded in small thicknesses onto stranded copper conductors at economically viable speeds, producing insulated conductors having substantially no air or other gases entrapped between the conductor and the insulation.

However, such fluoropolymers are generally very difficult to compression extrude through small die orifices to produce thin layers of insulation on conductors at economically viable speeds. Secondary bonding forces (such as Van der Waal's forces) within simple hydrocarbons, such as polyolefin-type polymers, may generally be about 40 KJoules/mole, while such forces within fluoropolymers may generally be about 4 KJoules/mole. Thus, fluoropolymers generally achieve their strength and toughness by having molecules with very high molecular weights that entangle with neighboring molecules to compensate for the low secondary bonding force. The high molecular weight of the fluoropolymers leads to considerably higher viscosities at their processing temperatures than other polymeric insulation materials. Further, many fluoropolymers may experience severe melt fracture, visible as excessive surface roughness, when compression extruded in small thicknesses due to their high molecular weights.

Accordingly, fluoropolymer insulation is typically extruded through large die orifices and the material is stretched, while in a melted state, to a desired thickness and shaped onto the conductor. While this process may produce cabling at economically viable speeds, air or other gases are often trapped between the conductor and the insulation.

The present invention is directed to overcoming, or at least reducing, the effects of one or more of the problems set forth above.

BRIEF SUMMARY OF THE INVENTION

In one aspect of the present invention, an electrical cable is provided. The electrical cable includes a conductor comprising a plurality of strands defining interstices therebetween and a first insulating layer comprising a polymer that is disposed on the conductor such that the first insulating layer substantially fills the interstices.

In another aspect of the present invention, an electrical cable is provided. The electrical cable includes a conductor comprising a plurality of strands defining interstices therebetween, a first insulating layer comprising a polymer that is disposed on the conductor such that the first insulating layer substantially fills the interstices, and an adhesion layer comprising a polymer that is disposed on the first insulating layer. The electrical cable further comprises a second insulating layer comprising a polymer that is disposed on the adhesion layer, wherein the adhesion layer is miscible with the polymer of the first insulating layer and the polymer of the second insulating layer.

In yet another aspect of the present invention, an electrical cable is provided. The electrical cable includes a conductor comprising a plurality of strands defining interstices therebetween, a first insulating layer comprising a polymer that is disposed on the conductor such that the first insulating layer substantially fills the interstices, and a second insulating layer comprising a polymer that is disposed on the first insulating layer. The electrical cable further includes a lubricating layer comprising a low molecular weight polymer that is disposed on the second insulating layer.

In another aspect of the present invention, an electrical cable is provided. The electrical cable includes a conductor comprising a plurality of strands defining interstices therebetween, a first insulating layer comprising a polymer that is disposed on the conductor such that the first insulating layer substantially fills the interstices, and an adhesion layer comprising a polymer that is disposed on the first insulating layer. The electrical cable further includes a second insulating layer comprising a polymer that is disposed on the adhesion layer and a lubricating layer comprising a low molecular weight polymer that is disposed on the second insulating layer, wherein the adhesion layer is miscible with the polymer of the first insulating layer and the polymer of the second insulating layer.

BRIEF DESCRIPTION OF THE DRAWINGS

The invention may be understood by reference to the following description taken in conjunction with the accompanying drawings, in which the leftmost significant digit(s) in the reference numerals denote(s) the first figure in which the respective reference numerals appear, and in which.

Figure 1:
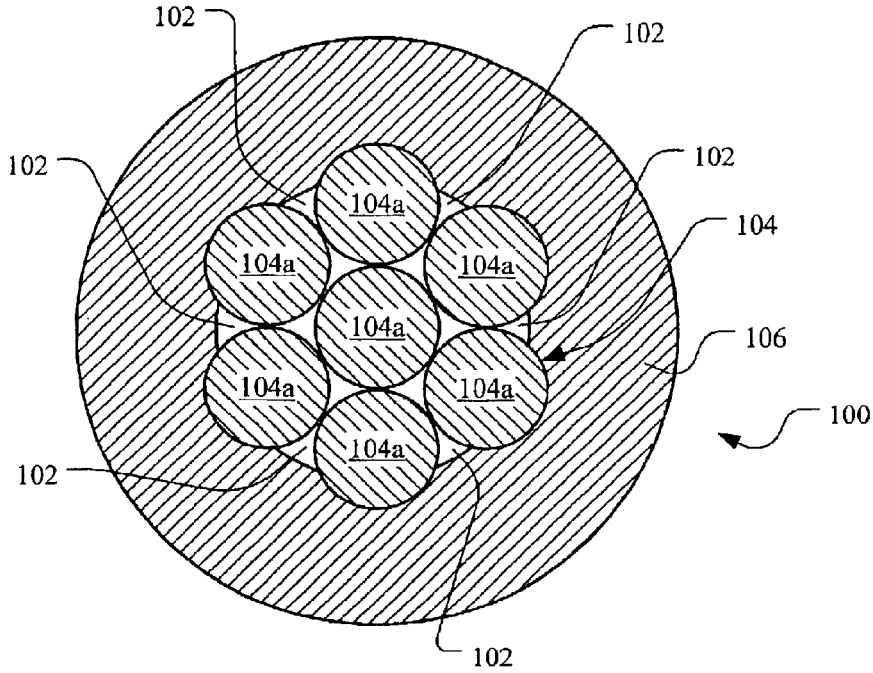
FIG. 1 PRIOR ART
FIG. 1 is a cross-sectional view of a conventional insulated electrical conductor or cable.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the scope of the invention as defined by the appended claims.

DETAILED DESCRIPTION OF THE INVENTION

Illustrative embodiments of the invention are described below. In the interest of clarity, not all features of an actual implementation are described in this specification. It will of course be appreciated that in the development of any such actual embodiment, numerous implementation-specific decisions must be made to achieve the developer's specific goals, such as compliance with system-related and business-related constraints, which will vary from one implementation to another. Moreover, it will be appreciated that such a development effort might be complex and time-consuming but would nevertheless be a routine undertaking for those of ordinary skill in the art having the benefit of this disclosure.

Figure 2:
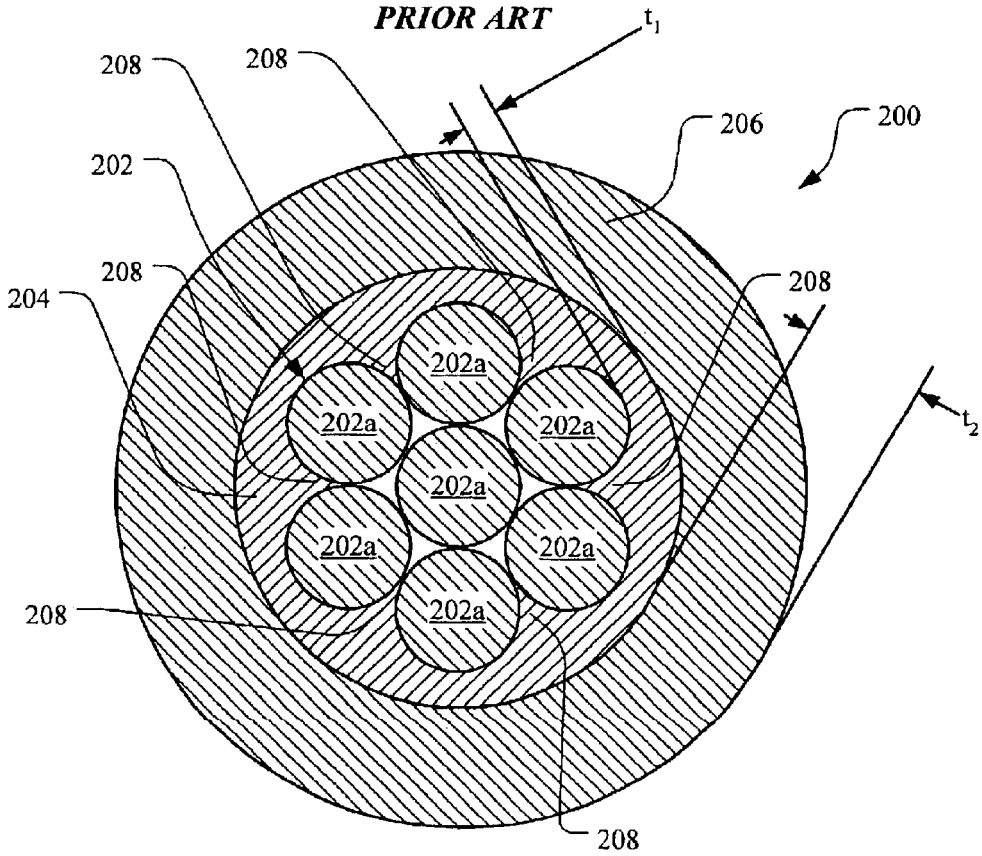
FIG. 2 is a cross-sectional view of a first illustrative embodiment of an insulated electrical conductor or cable according to the present invention.

FIG. 2 depicts, in cross-section, a first illustrative embodiment of an insulated electrical conductor or cable according to the present invention. In the illustrated embodiment, an electrical cable 200 includes a conductor 202 comprising a plurality of strands 202*a*, as shown in FIG. 2. The electrical cable 200 further comprises a first insulating layer 204 disposed between the conductor 202 and a second insulating layer 206. The first insulating layer 204 substantially fills interstices 208 between adjacent strands 202*a* of the conductor 202. Each of the first insulating layer 204 and the second insulating layer 206 electrically insulate the conductor 202.

In this first illustrative embodiment, the first insulating layer 204 comprises a low molecular weight polymer having, for example, a melt index greater than about 15. Such low molecular weight polymers may include injection moldable grade polymers. The melt index of a polymer is, in general, inversely proportional to its molecular weight and is defined as the amount, in grams, of the polymer that can be forced through a 2.0955 mm diameter extrusion orifice when subjected to an extrusion force defined for the particular material by American Society for Testing Materials (ASTM) standards for ten minutes at a temperature also defined for the particular material by ASTM standards. Low molecular weight polymers typically have lower viscosities than higher molecular weight polymers, which have lower melt indices. Thus, the lower viscosity of the low molecular weight polymer allows the first insulating layer 204 to flow into and substantially fill the interstices 208 (corresponding to the voids 102 of FIG. 1) between adjacent strands 202*a* of the conductor 202 as the first insulating layer 204 is formed onto the conductor 202. Accordingly, few if any voids are produced within the interstices 208 between the conductor 202 and the first insulating layer 204. Thus, the likelihood of air or other gases becoming entrapped between the conductor 202 and the first insulating layer 204 may be decreased.

While the present invention encompasses any low molecular weight polymer deemed suitable for the first insulating layer 204, in one embodiment, the first insulating layer 204 comprises a low molecular weight fluoropolymer, e.g., MFA 940 AX (co-polymer of tetrafluoroethylene and perfluoromethyl vinyl ether with a melt index of 140 to 150) manufactured by Ausimont U.S.A. of Thorofare, N.J., U.S.A. Such fluoropolymers are generally capable of withstanding higher temperatures encountered when the cable 200 is used in an oilfield wireline operation. In one embodiment, the first insulating layer 204 has a thickness $t_1$ within a range of about 0.002 mm to about 0.500 mm.

Low molecular weight polymers may generally lack the mechanical strength and wear resistance desired for electrical cables to be used in harsh environments, such as in oilfield wireline operations. Therefore, the second insulating layer 206 comprises a high molecular weight polymer that surrounds the first insulating layer 204 to provide a strong, wear resistant covering for the cable 200. Such high molecular weight polymers may include fluoropolymers having melt indices of about 15 or less. While the present invention encompasses any high molecular weight polymer deemed suitable for the second insulating layer 206, in one embodiment, the second insulating layer 206 comprises a high molecular weight fluoropolymer, e.g., MFA 620 (copolymer of tetrafluoroethylene and perfluoromethyl vinyl ether with a melt index of 2 to 5) manufactured by Ausimont U.S.A. of Thorofare, N.J., U.S.A. Such fluoropolymers are generally capable of withstanding higher temperatures and harsh physical conditions encountered when the cable 200 is used in an oilfield wireline operation. In one embodiment, the second insulating layer 206 has a thickness $t_2$ within a range of about 0.13 mm to about 1.30 mm.

While the present invention is not so limited, in one embodiment, the first insulating layer 204 and the second insulating layer 206 are made from different species of the same polymer having different molecular weights. For example, the first insulating layer 204 may be made from a low molecular weight fluoropolymer, while the second insulating layer 206 may be made from the same, but higher molecular weight, fluoropolymer.

As discussed above, reducing the likelihood of air or other gases becoming entrapped between the conductor 202 and the first insulating layer 204 generally decreases the likelihood that partial discharge of the electrical field will occur. In one embodiment, the first insulating layer 204 may have a higher permittivity than that of the second insulating layer 206, thus further decreasing the likelihood of partial discharge of the electrical field. Generally, materials having higher permittivity values can store more energy than materials having relatively lower permittivity values. Thus, higher permittivity materials are relatively more capable of allowing an opposing electrical field to exist therein when the cable 200 is in use. Such opposing electrical fields may counteract at least a portion of the electrical field produced by the voltage across the conductor 202.

Further, the combination of the first insulating layer 204 and the second insulating layer 206 may result in tangential electrical fields being produced within the insulating layers 204, 206 when the cable 200 is in use due to the higher permittivity, in a relative sense, of the first insulating layer 204 as compared to the second insulating layer 206. Such tangential electrical fields may also at least partially counteract the electrical field generated by the voltage across the conductor 202. In one embodiment, the polymer comprising the first insulating layer 204 has a permittivity within a range of about 2.8 to about 8.0, while the polymer comprising the second insulating layer 206 has a permittivity within a range of about 1.8 to about 2.7.

Figure 3:
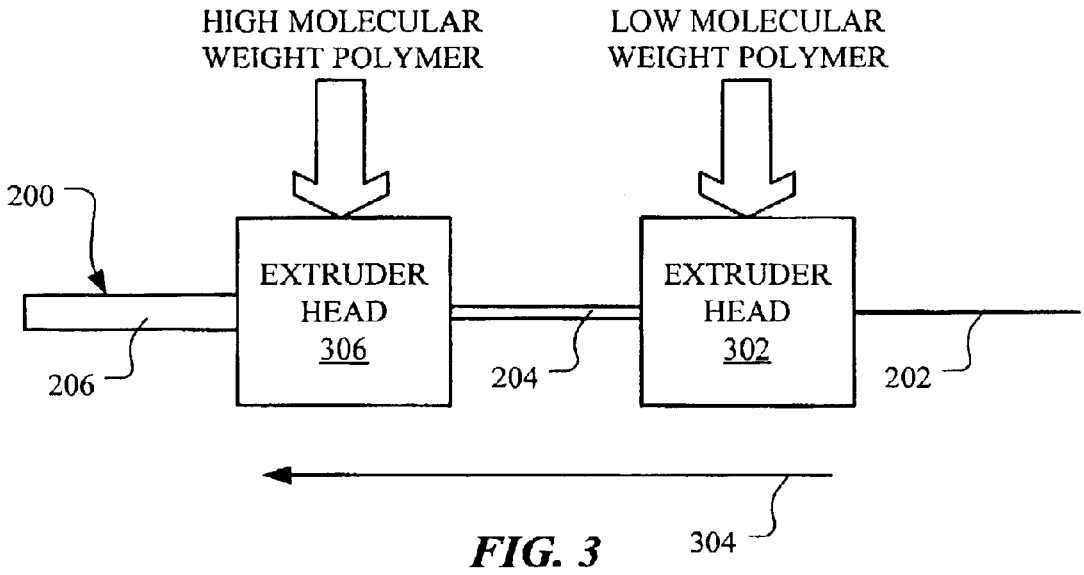
FIG. 3 is a block diagram of a first illustrative embodiment of a method for producing the insulated electrical conductor or cable of FIG. 2.

Each of the first insulating layer 204 and the second insulating layer 206 may be applied to the conductor 202 by any means known to the art. For example, the insulating layers 204, 206 may be applied to the conductor by compression, semi-compression, or tubing extrusion methods, as are generally known in the art. In one embodiment, depicted in FIG. 3, the conductor 202 is fed into a first extruder head 302 in a direction indicated by the arrow 304, wherein the low molecular weight polymer is extruded (e.g., by compression, semi-compression, or tubing extrusion methods) onto the conductor 202 to form the first insulating layer 204. Subsequently, the conductor 202, with the first insulating layer 204 applied thereto, is fed into a second extruder head 306 in the direction indicated by the arrow 304, wherein the high molecular weight polymer is formed on the first insulating layer 204 by a tubing process to form the second insulating layer 206, thus producing the cable 200.

Figure 4:
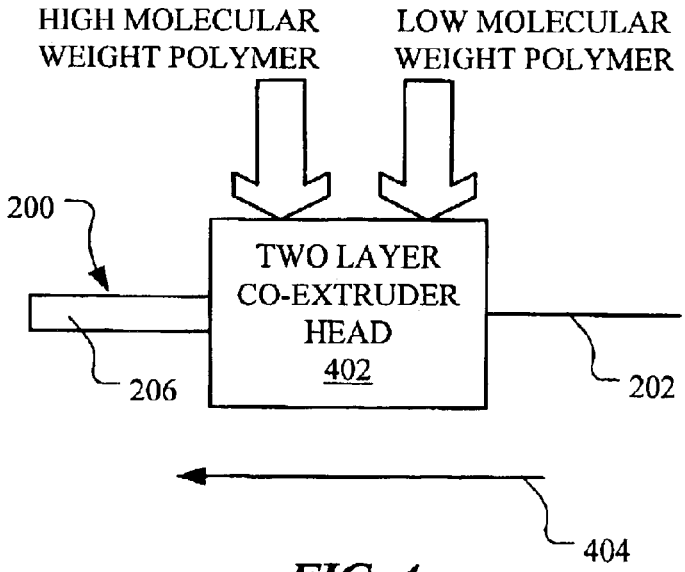
FIG. 4 is a block diagram of a second illustrative embodiment of a method for producing the insulated electrical conductor or cable of FIG. 2.

Alternatively, in the illustrative embodiment shown in FIG. 4, the conductor 202 is fed into a two layer co-extruder head 402 in a direction indicated by the arrow 404. In this embodiment, the low molecular weight polymer is extruded (e.g., by compression, semi-compression, or tubing methods) onto the conductor 202 to form the first insulating layer 204. The high molecular weight polymer is formed on the first insulating layer 204 by a tubing process performed by the same two layer co-extruder head 402 to form the second insulating layer 206, thus producing the cable 200.

It may be desirable in certain situations to compression or semi-compression extrude the second insulating layer 206 onto the first insulating layer 204. However, as discussed above, the second insulating layer comprises a high molecular weight polymer. Such polymers include large molecules that result in the polymer having a greater viscosity than that of low molecular weight polymers. Generally, greater viscosity leads to greater shear stress between high molecular weight polymers and the extrusion die (not shown) when extruded than between low molecular weight polymers and the extrusion die. This can lead to severe melt fracture cracking of the surface of the polymer.

Figure 5:
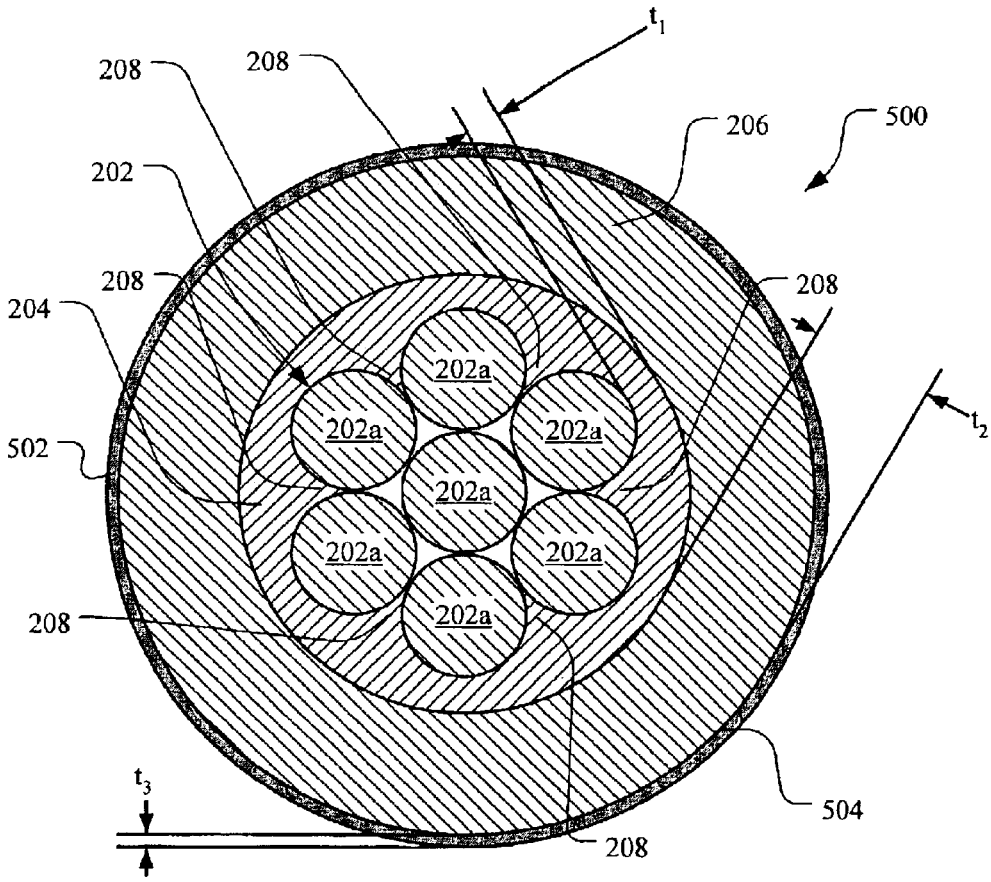
FIG. 5 is a cross-sectional view of a second illustrative embodiment of an insulated electrical conductor or cable according to the present invention.

Thus, in a second illustrative embodiment, shown in FIG. 5, an insulated electrical conductor or cable 500 is shown including a lubricating layer 502, comprising a lubricating polymer, such as a low molecular weight polymer, that has been added to an outer surface 504 of the second insulating layer 206. Other than the lubricating layer 502, the elements of the cable 500 generally correspond to the elements of the cable 200 and are so numbered. The low molecular weight material comprising the lubricating layer 502 decreases the shear stress (and thus melt fracture) between the second insulating layer 206 and the extrusion die, thereby allowing the second insulating layer 206 to be effectively compression or semi-compression extruded.

Still referring to FIG. 5, the lubricating layer 502 may comprise the same polymer as the first insulating layer 204, as described above, or may comprise any other desired low molecular weight polymer. In one embodiment, the lubricating layer 502 has a thickness $t_3$ within a range of about 0.002 mm to about 0.050 mm.

Figure 6:
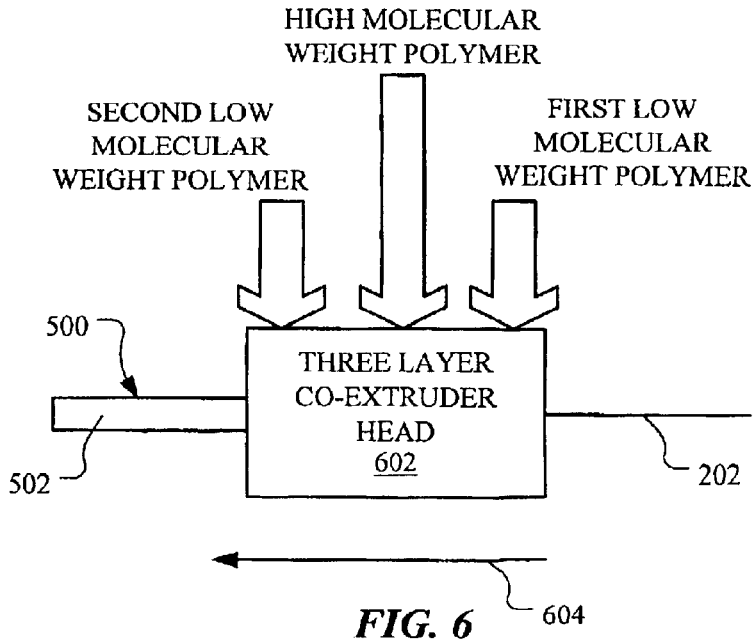
FIG. 6 is a block diagram of a first illustrative embodiment of a method for producing the insulated electrical conductor or cable of FIG. 5.

The cable 500 may be produced as illustrated in FIG. 6. The conductor 202 is fed into a three layer co-extruder head 602 in a direction indicated by arrow 604. Each of the first low molecular weight polymer and the high molecular weight polymer are compression or semi-compression extruded onto the conductor 202 by the three layer co-extruder head 602 to form each of the first insulating layer 204 and the second insulating layer 206, wherein a low molecular weight polymer is applied to the high molecular weight polymer just prior to extrusion to form the lubricating layer 502. Thus, the insulating layers 204, 206 and the lubricating layer 502 are co-extruded by the three layer co-extruder head 602.

Figure 7:
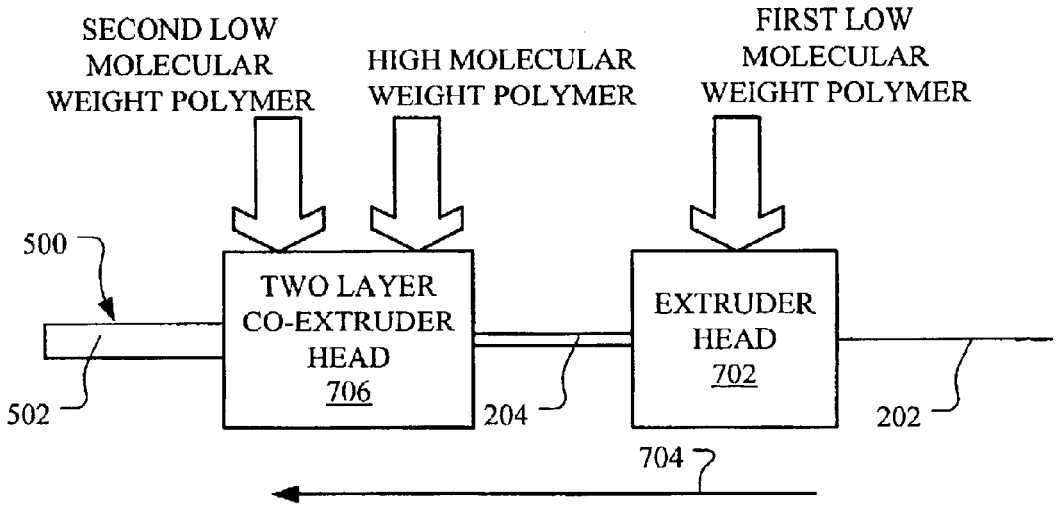
FIG. 7 is a block diagram of a second illustrative embodiment of a method for producing the insulated electrical conductor or cable of FIG. 5.

Alternatively, as illustrated in FIG. 7, the conductor 202 is fed into a first extruder head 702 in a direction indicated by arrow 704, wherein the first low molecular weight polymer is extruded (e.g., by compression, semi-compression, or tubing extrusion methods) onto the conductor 202 to form the first insulating layer 204. The conductor 202, with the first insulating layer 204 applied thereto, is then fed into a two layer co-extruder head 706, wherein the high molecular weight polymer and the second low molecular weight polymer are then compression or semi-compression extruded onto the first insulating layer 204 to form the second insulating layer 206 and the lubricating layer 502, respectively.

Figure 8:
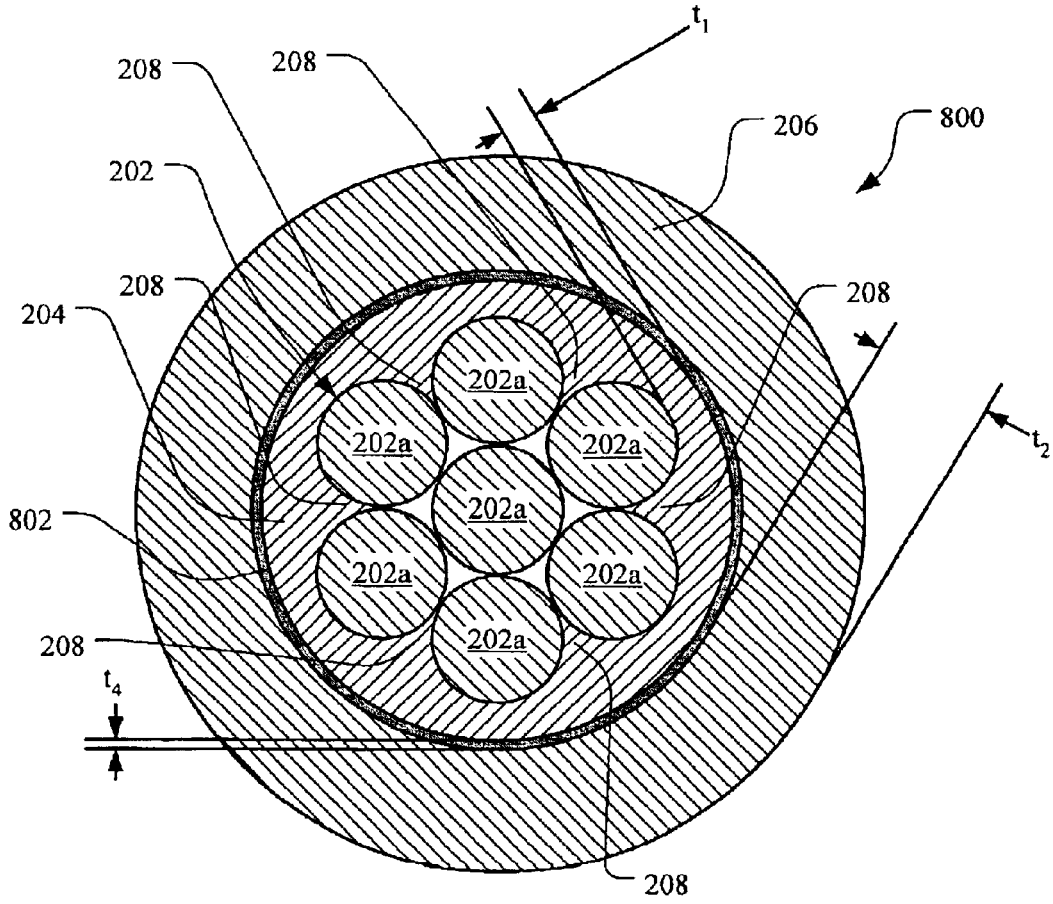
FIG. 8 is a cross-sectional view of a third illustrative embodiment of an insulated electrical conductor or cable according to the present invention.

It may be generally desirable for the first insulating layer 204 and the second insulating layer 206, as illustrated in FIG. 2, to bond to each other during extrusion, so that the insulating layers 204, 206 become integral. Some polymers that may be chosen for the insulating layers 204, 206, however, may be immiscible and, thus, fail to bond together sufficiently. Accordingly, a third illustrative embodiment of an electrical cable according to the present invention is depicted in FIG. 8. The cable 800 includes an adhesion layer 802 that is disposed between the first insulating layer 204 and the second insulating layer 206. Other elements of the cable 800 generally correspond to the cable 200 of FIG. 2 and are numbered accordingly. The adhesion layer 802 comprises a polymer that is miscible with both the first insulating layer 204 and the second insulating layer 206. The polymer making up the adhesion layer 802 may vary widely, depending upon the polymers chosen for the insulating layers 204, 206.

For example, if the first insulating layer 204 comprises nylon and the second insulating layer 206 comprises ethylene tetrafluoroethylene (ETFE), such as regular Tefzel 2183 manufactured by E.I. du Pont de Nemours and Company (DuPont) of Wilmington, Del., U.S.A., it is unlikely that they will sufficiently bond together. In this example, the adhesion layer 802 may comprise modified Tefzel HT-2202, also manufactured by DuPont, which is miscible with both nylon and regular Tefzel. Thus, the insulating layers 204, 206 may be bonded together via the adhesion layer 802. In one embodiment, the adhesion layer 802 may have a thickness $t_4$ within a range of about 1 to 2 mils.

Figure 9:
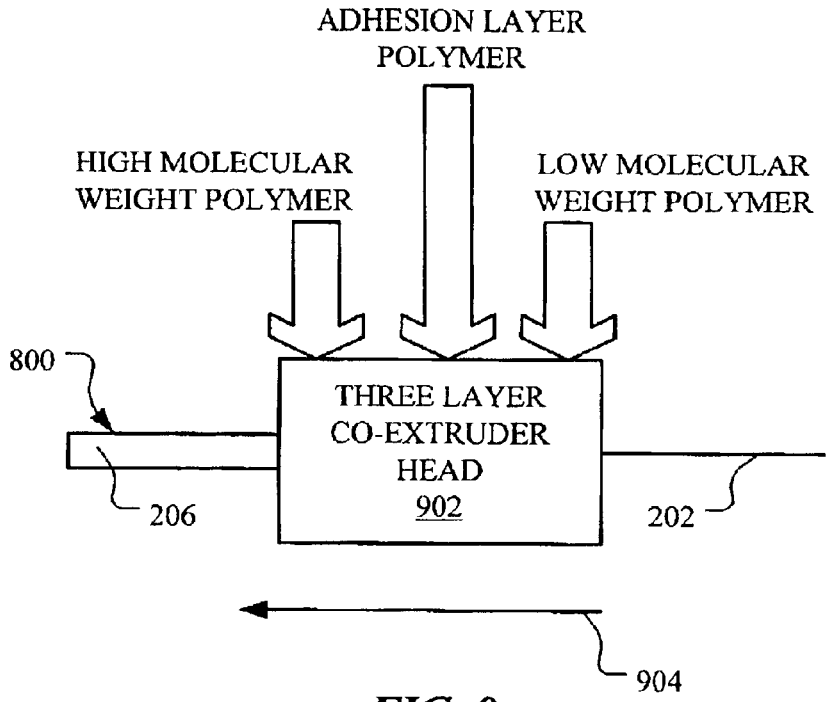
FIG. 9 is a block diagram of a first illustrative embodiment of a method for producing the insulated electrical conductor or cable of FIG. 8.

The cable 800 may be produced as illustrated in FIG. 9. The conductor 202 is fed into a three layer co-extruder head 902 in a direction indicated by the arrow 904. The low molecular weight polymer and the adhesion layer polymer are extruded (e.g., by compression, semi-compression, or tubing extrusion methods) onto the conductor 202 to form the first insulating layer 204 and the adhesion layer 802, respectively. The high molecular weight polymer is then formed on the adhesion layer 802 by a tubing extrusion process performed by the three layer co-extruder head 902 to form the second insulating layer 206.

Figure 10:
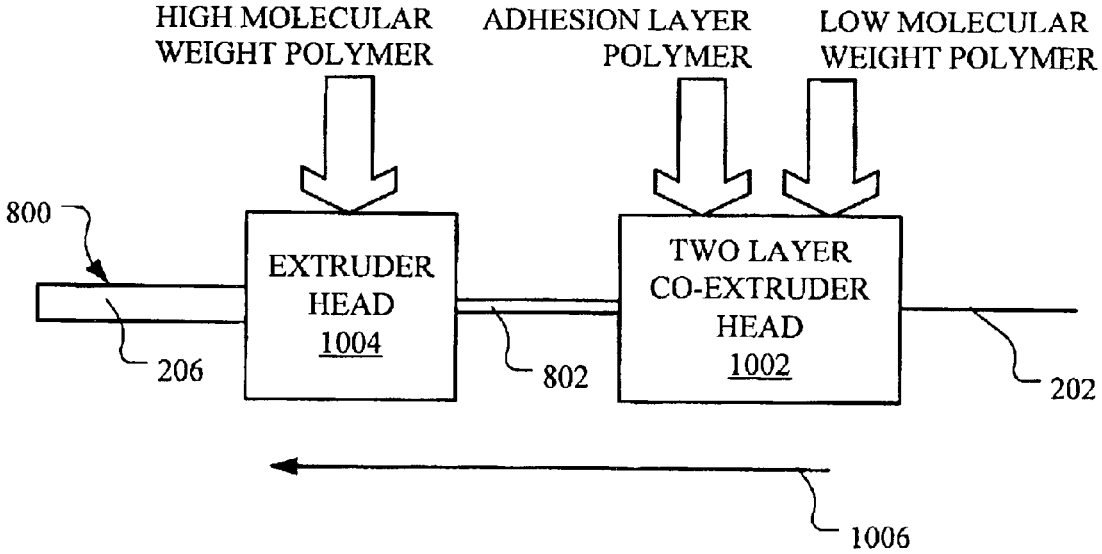
FIG. 10 is a block diagram of a second illustrative embodiment of a method for producing the insulated electrical conductor or cable of FIG. 8.

Alternatively, as shown in FIG. 10, a two layer co-extruder head 1002 may co-extrude the first insulating layer 204 and the adhesion layer 802 and a second extruder head 1004 may apply the second insulating layer 206. In this illustrative embodiment, the conductor 202 is fed into the extruder 1002 in a direction indicated by arrow 1006, wherein the low molecular weight polymer and the adhesion layer polymer are extruded (e.g., by compression, semi-compression, or tubing extrusion methods) onto the conductor 202 to form the first insulating layer 204 and the adhesion layer 802, respectively. The high molecular weight polymer is then formed on the adhesion layer 802 by a tubing extrusion process performed by extruder head 1004 to form the second insulating layer 206.

Figure 11:
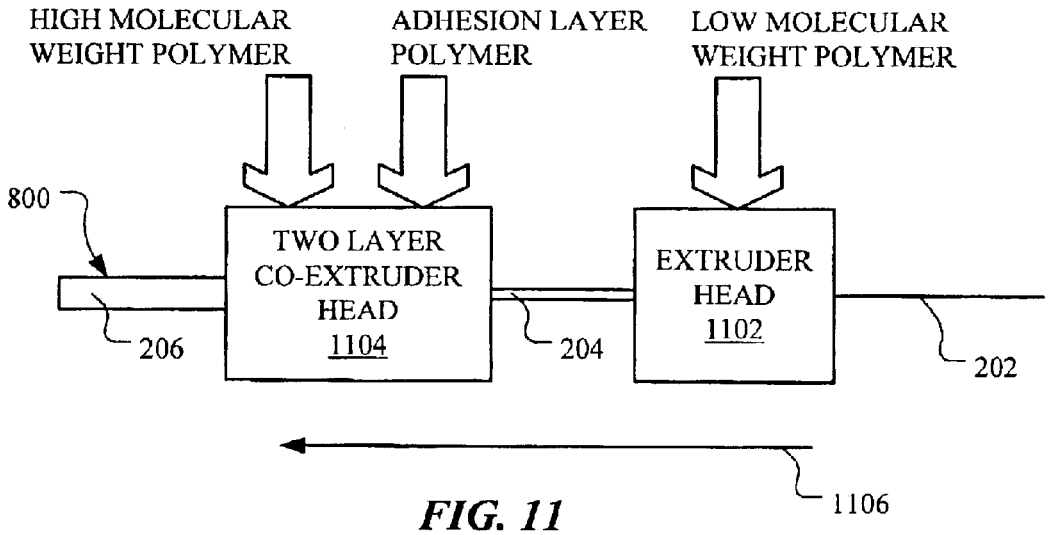
FIG. 11 is a block diagram of a third illustrative embodiment of a method for producing the insulated electrical conductor or cable of FIG. 8.

The invention, however, is not so limited. Rather, as illustrated in FIG. 11, an extruder head 1102 may apply only the first insulating layer 204 and a two layer co-extruder head 1104 may co-extrude each of the adhesion layer 802 and the second insulating layer 206. In this illustrative embodiment, the conductor 202 is fed into the extruder head 1102 in a direction indicated by arrow 1106, wherein the low molecular weight polymer is extruded (e.g., by compression, semi-compression, or tubing extrusion methods) onto the conductor 202 to form the first insulating layer 204. The adhesion layer polymer is extruded (e.g., by compression, semi-compression, or tubing methods) onto the first insulating layer 204 to form the adhesion layer 802 and the high molecular weight polymer is formed on the adhesion layer 802 by a tubing extrusion process performed by two layer co-extruder head 1104 to form the second insulating layer 206.

Figure 12:
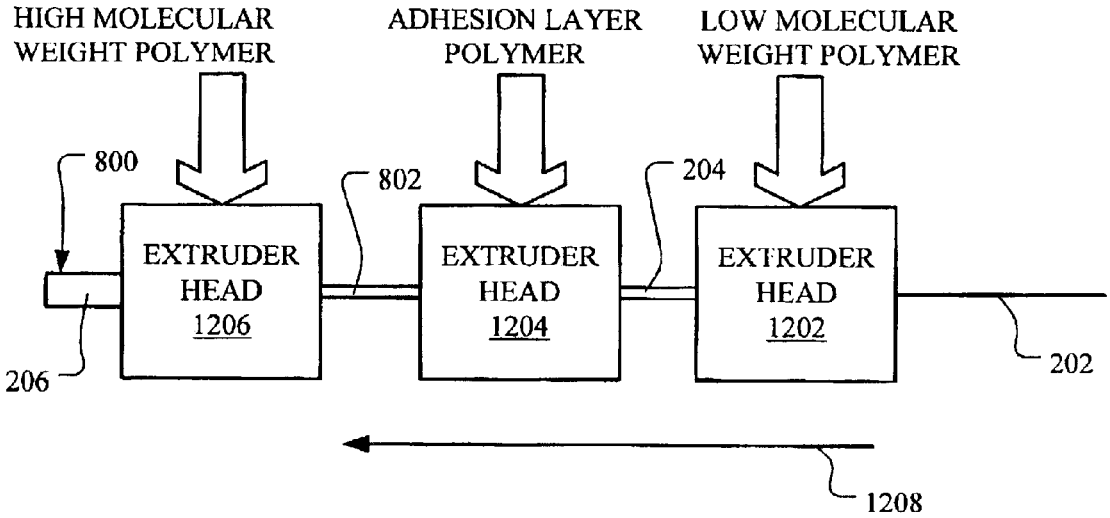
FIG. 12 is a block diagram of a fourth illustrative embodiment of a method for producing the insulated electrical conductor or cable of FIG. 8.

Each of the first insulation layer 204, the adhesion layer 802, and the second insulating layer 206 may be applied by separate extruder heads 1202, 1204, 1206, respectively, as illustrated in FIG. 12. In this illustrative embodiment, the conductor 202 is fed into the first extruder head 1202 in a direction indicated by arrow 1208, wherein the low molecular weight polymer is extruded (e.g., by compression, semi-compression, or tubing extrusion methods) onto the conductor 202 to form the first insulating layer 204. The conductor 202, with the first insulating layer 204 applied thereon, is then fed into the second extruder head 1204, wherein the adhesion layer polymer is extruded (e.g., by compression, semi-compression, or tubing extrusion methods) onto the first insulating layer 204 to form the adhesion layer 802. The conductor 202, with the first insulating layer 204 and the adhesion layer 802 applied thereon, is then fed into the third extruder head 1206, wherein the high molecular weight polymer is formed onto the adhesion layer 802 by a tubing extrusion process performed by the third extruder head 1206.

Figure 13:
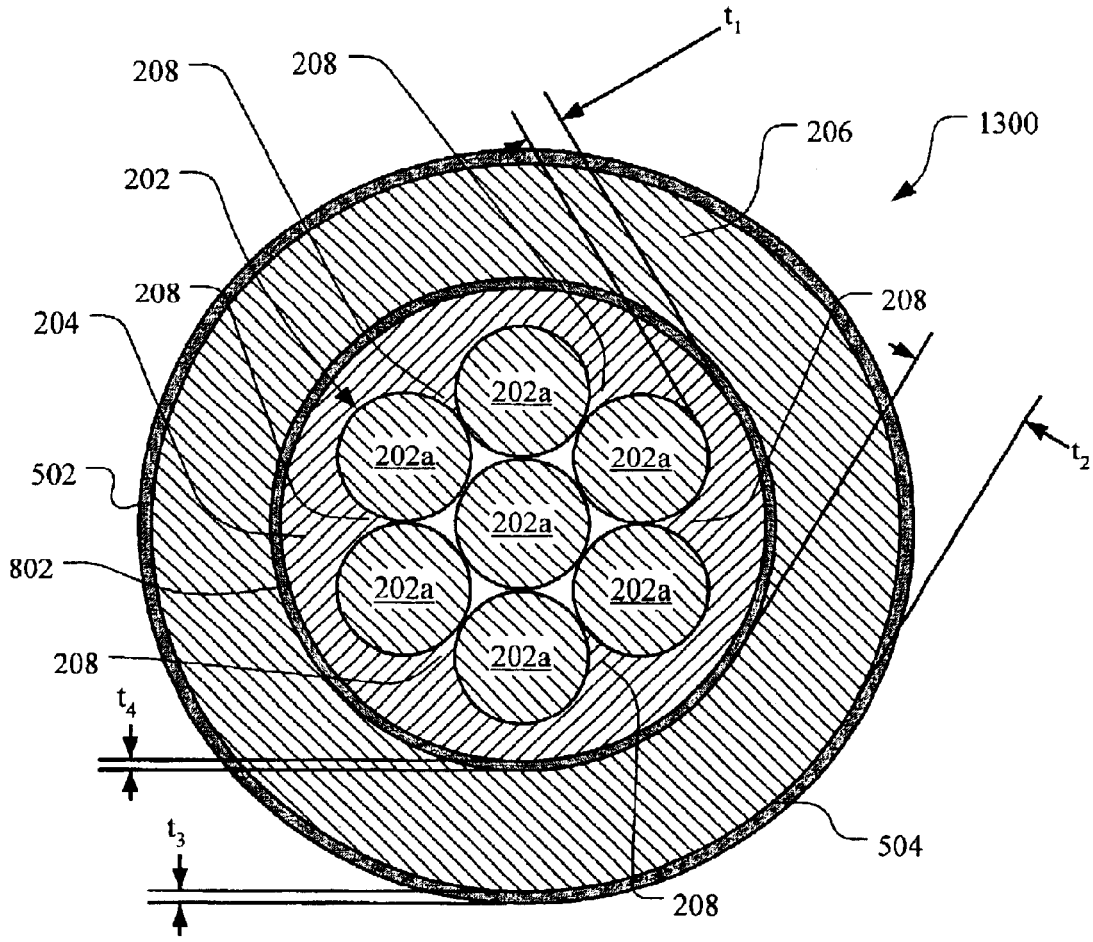
FIG. 13 is a cross-sectional view of a fourth illustrative embodiment of an insulated electrical conductor or cable according to the present invention.

As indicated previously, it may be desirable in certain situations to compression or semi-compression extrude the second insulating layer 206, which comprises the high molecular weight polymer. In a fourth illustrative embodiment, shown in FIG. 13, a cable 1300 is shown including a lubricating layer 502, comprising a low molecular weight polymer or other easily compression extrudable polymer such as nylon, polyetherether-ketone (PEEK), or polyphenylene sulfide (PPS), that has been added to an outer surface 504 of the second insulating layer 206. Other than the lubricating layer 502, the elements of the cable 1300 generally correspond to the elements of the cable 800 and are so numbered. As described in relation to the second embodiment (depicted in FIG. 5), the lubricating layer 502 decreases the friction between the second insulating layer 206 and the extrusion die (not shown), thereby allowing the second insulating layer 206 to be effectively compression extruded.

Figure 14:
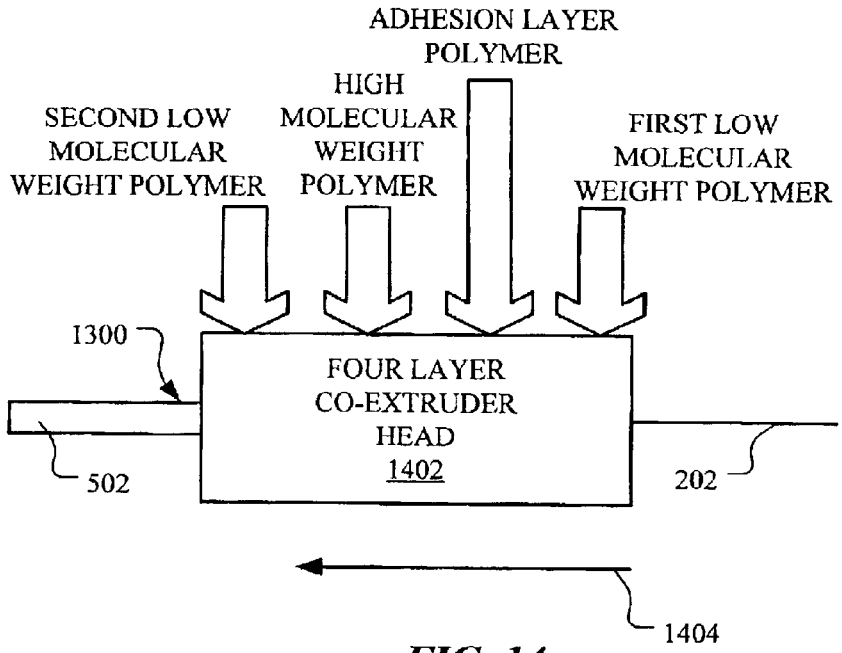
FIG. 14 is a block diagram of a first illustrative embodiment of a method for producing the insulated electrical conductor or cable of FIG. 13.

The cable 1300 may be produced as illustrated in FIG. 14. The conductor 202 is fed into a four layer co-extruder head 1402 in a direction indicated by the arrow 1404. The first low molecular weight polymer and the adhesion layer polymer are co-extruded (e.g., by compression, semi-compression, or tubing extrusion methods) onto the conductor 202 to form the first insulating layer 204 and the adhesion layer 802, respectively. The high molecular weight polymer and the second low molecular weight polymer are also compression or semi-compression extruded onto the adhesion layer 802 by the four layer co-extruder head 1402 to form the second insulating layer 206 and the lubricating layer 502, respectively. Thus, the insulating layers 204, 206, the adhesion layer 802, and the lubricating layer 502 are co-extruded by the four layer co-extruder head 1402. It should be noted that cable 1300 may be manufactured on a three layer co-extruder head if the adhesion layer 802 is omitted.

Figure 15:
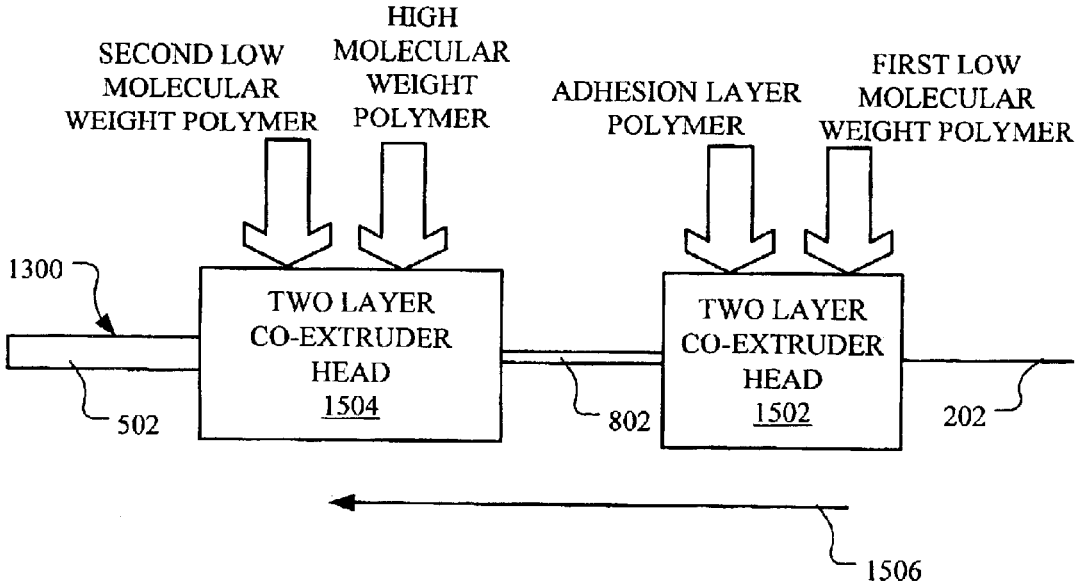
FIG. 15 is a block diagram of a second illustrative embodiment of a method for producing the insulated electrical conductor or cable of FIG. 13.

Alternatively, as shown in FIG. 15, a first two layer co-extruder head 1502 may co-extrude the first insulating layer 204 and the adhesion layer 802 and a second two layer co-extruder head 1504 may co-extrude the second insulating layer 206 and the lubricating layer 502. In this illustrative embodiment, the conductor 202 is fed into the two layer co-extruder head 1502 in a direction indicated by arrow 1506, wherein the first low molecular weight polymer and the adhesion layer polymer are extruded (e.g., by compression, semi-compression, or tubing extrusion methods) onto the conductor 202 to form the first insulating layer 204 and the adhesion layer 802, respectively. The high molecular weight polymer and the second low molecular weight polymer are then compression or semi-compression extruded onto the adhesion layer 802 by the second two layer co-extruder head 1504 to form the second insulating layer 206 and the lubricating layer 502, respectively.

Figure 16:
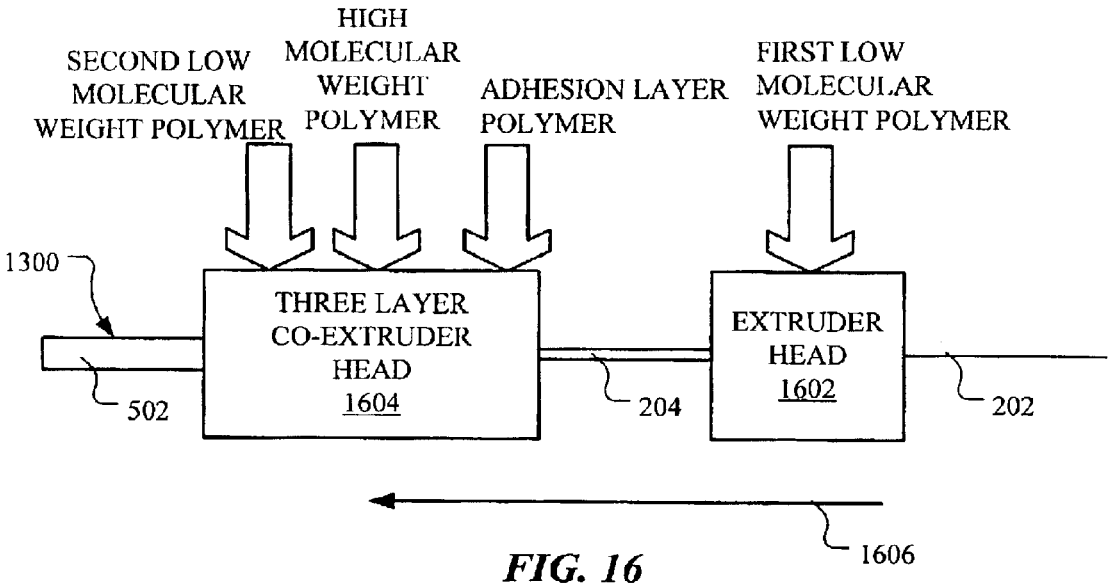
FIG. 16 is a block diagram of a third illustrative embodiment of a method for producing the insulated electrical conductor or cable of FIG. 13.

The invention, however, is not so limited. Rather, as illustrated in FIG. 16, an extruder head 1602 may apply only the first insulating layer 204 and a three layer co-extruder head 1604 may co-extrude each of the adhesion layer 802, the second insulating layer 206, and the lubricating layer 502. In this illustrative embodiment, the conductor 202 is fed into the extruder head 1602 in a direction indicated by arrow 1606, wherein the first low molecular weight polymer is extruded (e.g., by compression, semi-compression, or tubing extrusion methods) onto the conductor 202 to form the first insulating layer 204. The adhesion layer polymer, the high molecular weight polymer, and the second low molecular weight polymer are compression or semi-compression extruded onto the first insulating layer 204 by the three layer co-extruder head 1604 to form the adhesion layer 802, the second insulating layer 206, and the lubricating layer 502, respectively.

Figure 17:
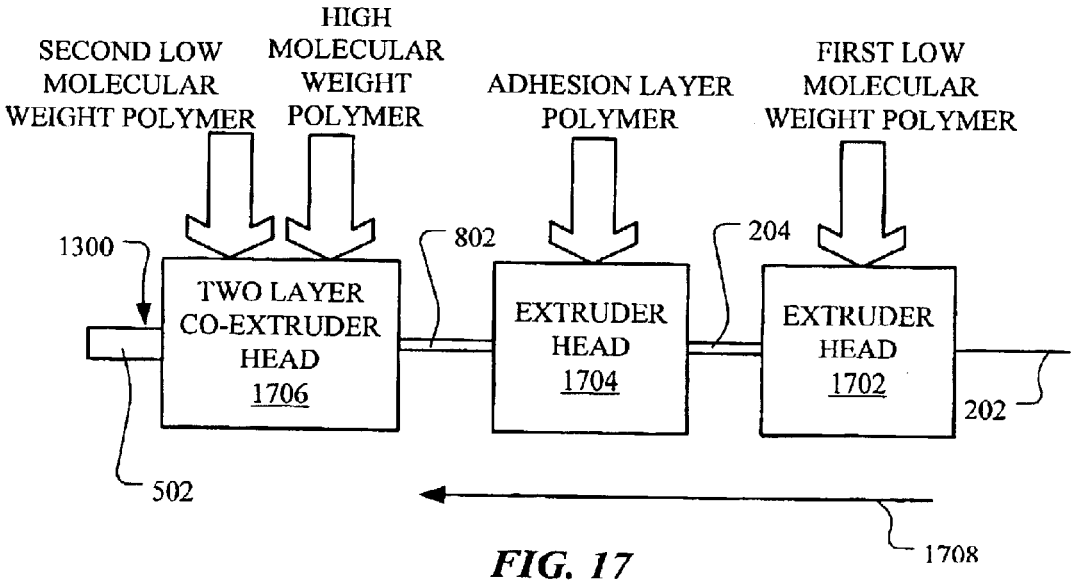
FIG. 17 is a block diagram of a fourth illustrative embodiment of a method for producing the insulated electrical conductor or cable of FIG. 13.

Each of the first insulation layer 204, the adhesion layer 802, and the second insulating layer 206 may be applied by separate extruder heads 1702, 1704, 1706, respectively, as illustrated in FIG. 17. In this illustrative embodiment, the conductor 202 is fed into the first extruder head 1702 in a direction indicated by arrow 1708, wherein the first low molecular weight polymer is extruded (e.g., by compression, semi-compression, or tubing extrusion methods) onto the conductor 202 to form the first insulating layer 204. The conductor 202, with the first insulating layer 204 applied thereon, is then fed into the second extruder head 1704, wherein the adhesion layer polymer is extruded (e.g., by compression, semi-compression, or tubing extrusion methods) onto the first insulating layer 204 to form the adhesion layer 802. The conductor 202, with the first insulating layer 204 and the adhesion layer 802 applied thereon, is then fed into the two layer co-extruder 1706, wherein the high molecular weight polymer and the second low molecular weight polymer are compression or semi-compression extruded onto the adhesion layer 802 to form the second insulating layer 206 and the lubricating layer 502, respectively.

While extrusion has been presented herein as a means for applying the insulating layers 204, 206, the lubrication layer 502, and the adhesion layer 802 in various embodiments, the present invention is not so limited. Rather, any means known to the art may be used to apply the layers 204, 206, 502, 802. For example, a pultrusion process may be used to apply a high molecular weight polymer as the first insulating layer 204. Pultrusion, as it relates to electrical cable insulation, is generally defined as a process of pulling a conductor through a polymer, such that the polymer clings to the conductor. The coated conductor is then pulled through a heated shaping die where the polymer is softened and formed into an insulating layer.

Figure 18:
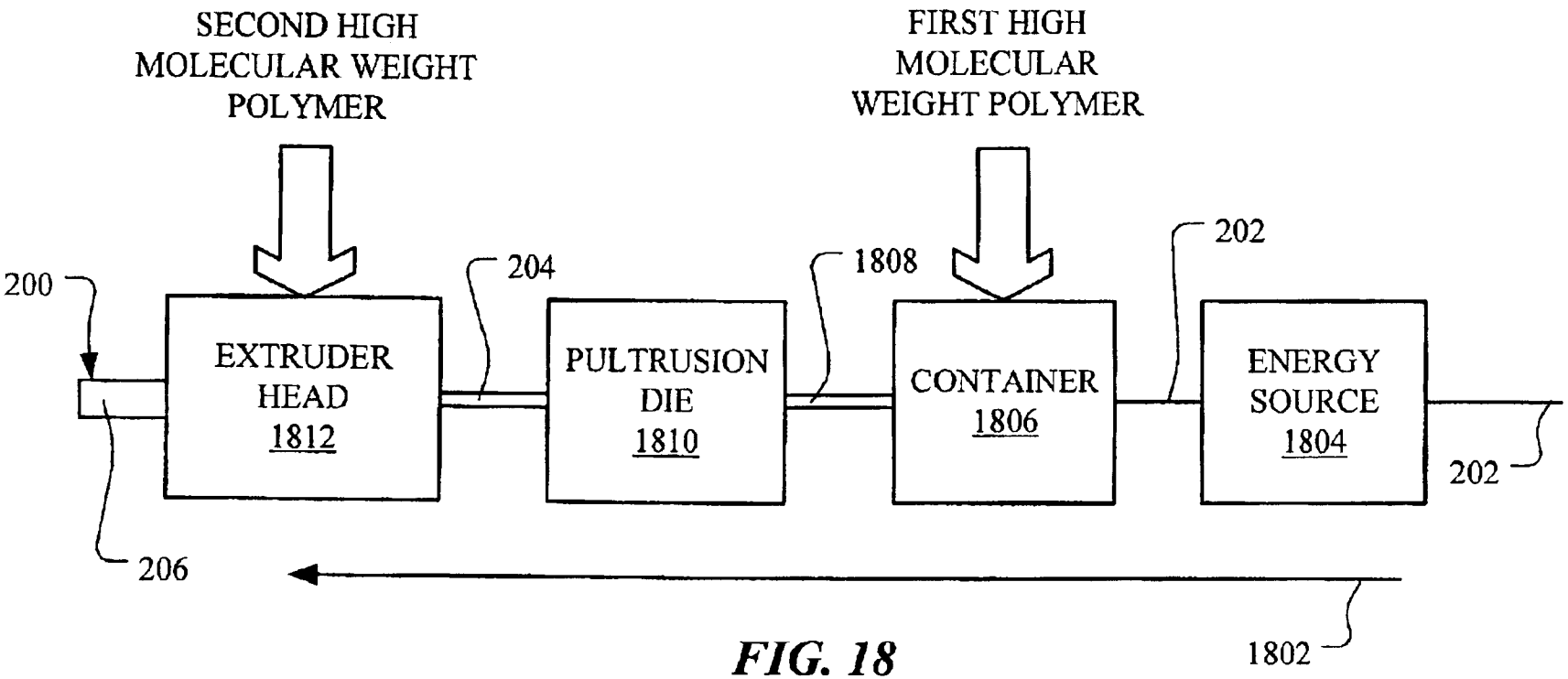
FIG. 18 is a block diagram of a pultrusion method for producing the insulated electrical conductor or cable of FIG. 2.

In one illustrative embodiment shown in FIG. 18, the conductor 202 is fed, in a direction corresponding to arrow 1802, into an energy source 1804. The energy source 1804 affects the conductor 202 such that particles of the first high molecular weight polymer may cling to the conductor 202. In one illustrative embodiment, the energy source 1804 is an electrostatic energy source that applies an electrostatic charge to the conductor 202 that differs from such a charge on the high molecular weight polymer. Alternatively, the energy source 1804 is a thermal energy source (e.g., a heater or the like) that applies heat to the conductor 202.

As the conductor 202 is then fed through a container 1806 containing the particles (powder) of the first high molecular weight polymer, the polymer clings to the conductor 202, forming an unconsolidated coating 1808 of the high molecular weight polymer on the conductor 202. In one illustrative embodiment, the container 1806 contains a fluidized bed of the first high molecular weight polymer. The coated conductor 202 is heated to make the polymer particles melt before it is pulled through a heated pultrusion die 1810, which compresses and consolidates the coating 1808 to form the first insulating layer 204. The combination of the heat and compression provided by the pultrusion die 1810 forces the high molecular weight polymer into the interstices 208 (as shown in FIG. 2) between the strands 202*a* of the conductor 202. Thus, few if any voids are produced within the interstices 208 and the likelihood of air or other gases becoming entrapped within the interstices 208 is decreased.

In this illustrative embodiment, the conductor 202, with the first insulating layer 204 applied thereto, is fed into an extruder head 1812, wherein the second high molecular weight polymer is extruded onto the first insulating layer 204 to form the second insulating layer 206. While the illustrative embodiment shown in FIG. 18 depicts the production of the cable 200, the present invention is not so limited. Rather, the pultrusion process shown in FIG. 18 may be applied to any embodiment of the present cable and may be applied to any embodiment of a method to produce such a cable. For example, the pultrusion process may be used to apply any of the insulating layers 204, 206 and the adhesion layer 802 and may be used to form polymers into such layers irrespective of their molecular weights. Further, such a cable may have only one insulating layer (e.g., the first insulating layer 204) applied onto the conductor 202. Such a pultrusion method may also be used to apply a thin layer of high molecular weight fluoropolymer or other polymers to metallic tubes or polymer composite rods.

The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope of the invention. Accordingly, the protection sought herein is as set forth in the claims below.

What is claimed is:

1. An electrical cable, comprising:

a conductor comprising a plurality of strands defining interstices therebetween;

a first insulating layer comprising a polymer that is disposed on the conductor such that the first insulating layer substantially fills the interstices, wherein the polymer of the first insulating layer comprises a low molecular weight polymer; and a second insulating layer comprising a high molecular weight polymer that is disposed on the first insulating layer;

wherein the first insulating layer has a thickness within a range of about 0.002 mm to about 0.500 mm.

2. An electrical cable, according to claim 1, wherein:

the polymer of the first insulating layer has a first permittivity; and the polymer of the second insulating layer has a second permittivity that is lower than the first permittivity.

3. An electrical cable, according to claim 1, wherein:

the polymer of the first insulating layer has a permittivity within a range of about 2.8 to about 8.0; and the polymer of the second insulating layer has a permittivity within a range of about 1.8 to about 2.7.

4. An electrical cable, according to claim 1, wherein the first insulating layer comprises a fluoropolymer.

5. An electrical cable, according to claim 1, wherein the second insulating layer has a thickness within a range of about 0.13 mm to about 1.30 mm.

6. An electrical cable, according to claim 1, wherein the polymer of the first insulating layer has a melt index greater than about 15.

7. An electrical cable, according to claim 1, wherein the polymer of the second insulating layer has a melt index of about 15 or less.

8. An electrical cable, according to claim 1, wherein the polymer of the first insulating layer has a permittivity within a range of about 2.8 to about 8.0.

9. An electrical cable, according to claim 1, wherein the second insulating layer comprises a fluoropolymer.

10. An electrical cable, according to claim 1, wherein the polymer of the first insulating layer and the polymer of the second insulating layer comprise different species of the same polymer, wherein the polymer of the first insulating layer has a lower molecular weight than the polymer of the second insulating layer.

11. An electrical cable, comprising:

a conductor comprising a plurality of strands defining interstices therebetween;

a first insulating layer comprising a polymer that is disposed on the conductor such that the first insulating layer substantially fills the interstices, the polymer of the first insulating layer comprising a low molecular weight polymer;

an adhesion layer comprising a polymer that is disposed on the first insulating layer; and a second insulating layer comprising a polymer that is disposed on the adhesion layer, the polymer of the second insulating layer comprising a high molecular weight polymer;

wherein the adhesion layer is miscible with the polymer of the first insulating layer and the polymer of the second insulating layer.

12. An electrical cable, according to claim 11, wherein the adhesion layer comprises a fluoropolymer.

13. An electrical cable, according to claim 11, wherein:

the polymer of the first insulating layer has a first permittivity; and the polymer of the second insulating layer has a second permittivity that is lower than the first permittivity.

14. An electrical cable, according to claim 11, wherein the first insulating layer comprises a fluoropolymer.

15. An electrical cable, according to claim 11, wherein the second insulating layer comprises a fluoropolymer.

16. An electrical cable, according to claim 11, wherein the polymer of the first insulating layer and the polymer of the second insulating layer comprise different species of the same polymer.

17. An electrical cable, comprising:

a conductor comprising a plurality of strands defining interstices therebetween;

a first insulating layer comprising a polymer that is disposed on the conductor such that the first insulating layer substantially fills the interstices, the polymer of the first insulating layer comprising a low molecular weight polymer;

a second insulating layer comprising a polymer that is disposed on the first insulating layer, the polymer of the second insulating layer comprising a high molecular weight polymer; and a lubricating layer comprising a low molecular weight polymer that is disposed on the second insulating layer.

18. An electrical cable, according to claim 17, wherein the lubricating layer comprises a fluoropolymer, the lubricating layer being extruded on the second insulating layer.

19. An electrical cable, according to claim 17, wherein the lubricating layer has a thickness within a range of about 0.002 mm to about 0.050 mm.

20. An electrical cable, according to claim 17, wherein the first insulating layer comprises a fluoropolymer.

21. An electrical cable, comprising:

a conductor comprising a plurality of strands defining interstices therebetween;

a first insulating layer comprising a polymer that is disposed on the conductor such that the first insulating layer substantially fills the interstices, the polymer of the first insulating layer comprising a low molecular weight polymer;

an adhesion layer comprising a polymer that is disposed on the first insulating layer;

a second insulating layer comprising a polymer that is disposed on the adhesion layer, the polymer of the second insulating layer comprising a high molecular weight polymer; and a lubricating layer comprising a low molecular weight polymer that is disposed on the second insulating layer;

wherein the adhesion layer is miscible with the polymer of the first insulating layer and the polymer of the second insulating layer.

22. An electrical cable, according to claim 21, wherein the adhesion layer further comprises a fluoropolymer.

23. A method for producing an electrical cable, comprising:

providing a conductor comprising a plurality of strands defining interstices therebetween;

applying a first insulating layer to the conductor such that the interstices are substantially filled by the first insulating layer, the first insulating layer comprising a low molecular weight polymer;

applying an adhesion layer to the first insulating layer; and applying a second insulating layer to the adhesion layer, the second insulating layer comprising a high molecular weight polymer.

* * * * *